US005285538A

United States Patent [19]

Hodak

[11] Patent Number: 5,285,538

[45] Date of Patent: Feb. 15, 1994

[54] SEALING ASSEMBLY FOR A SWIMMING POOL SKIMMER

[76] Inventor: Frank J. Hodak, E. Cruikshank Rd., Valencia, Pa. 16059

[21] Appl. No.: 869,136

[22] Filed: Apr. 14, 1992

[51] Int. Cl.[5] ..... E04H 4/00

[52] U.S. Cl. ..... 4/507; 210/169; 210/416.2; 220/308; 220/378; 220/241

[58] Field of Search ..... 210/169, 416.2; 285/901; 138/89; 220/241, 378, 308, 306; 4/494, 496, 507, 508, 512

[56] References Cited

U.S. PATENT DOCUMENTS

| | | | |
|---|---|---|---|
| 3,239,149 | 3/1966 | Lindberg, Jr. | 4/507 |
| 3,445,973 | 5/1969 | Stone | 4/293 |
| 3,733,621 | 5/1973 | Jannuzzi, Jr. | 4/506 |
| 3,900,130 | 8/1975 | Andrews | 220/242 |
| 4,126,925 | 11/1978 | Jacuzzi | 4/490 |
| 4,368,550 | 1/1983 | Stevens | 4/507 |
| 4,735,714 | 4/1988 | Schall | 4/512 |
| 4,903,351 | 2/1990 | Dengel et al. | 4/508 |
| 4,913,810 | 4/1990 | Hodak | 210/169 |
| 5,040,250 | 8/1991 | Barnes et al. | 4/494 |

OTHER PUBLICATIONS

Hayward Pool Products Catalog, p. 64, ®1991.

*Primary Examiner*—Peter A. Hruskoci
*Assistant Examiner*—Robert James Popovics
*Attorney, Agent, or Firm*—Webb, Burden, Ziesenheim & Webb

[57] ABSTRACT

A sealing assembly is provided for a swimming pool skimmer. The sealing assembly includes a face plate having either one of a laterally extending, raised bead or an outwardly extending flange around the periphery thereof. A flexible cover element includes a peripheral lip for sealably engaging the raised bead or the flange of the face plate. The flexible cover element also includes a planar portion which bears against the flat surface of the face plate around the central opening therein to provide secondary or primary sealing.

8 Claims, 2 Drawing Sheets

SEALING ASSEMBLY FOR A SWIMMING POOL SKIMMER

The present invention relates generally to swimming pools and, more particularly, to sealing apparatus for closing off the sidewall opening of a skimmer to prevent water from entering the skimmer when the pool is closed for the season.

It is common to employ one or more skimmer devices in the sidewalls of swimming pools, hot tubs and the like to permit surface water to be drawn off by a pump, filtered at a remote location and returned to the pool through one or more return ports. When the pool is closed during the winter season, it is sometimes desirable to maintain a level of water in the pool for structural purposes. In such cases, it is necessary to close off the skimmer to prevent back flow of water through the skimmer conduit to the filtration equipment so as to prevent damage to the pipes and filtration equipment due to freezing during the cold winter months.

One common way of closing off the skimmer is to employ an elongated plug-like element, marketed under the trademark "GIZMO". The plug element is threadably secured within the floor of the skimmer to seal the conduit communicating with the pump and the filtration equipment. U.S. Pat. No. 4,913,810, owned by the applicant, discloses a system for closing off a skimmer opening by providing a cover panel for securement on an extra gasket frame which is specially fitted between the pool sidewall and the skimmer face plate. In order to use the device of U.S. Pat. No. 4,913,810, it is first necessary to physically remove the face plate from the skimmer and pool sidewall in order to install the special gasket frame therebetween. Needless to say, this requires extra labor and expense which may cause the average swimming pool owner to choose not to employ such a retrofit. The extra plate may also cause leakage if not properly installed. The present invention solves the problems found in prior skimmer sealing devices by providing a skimmer closure system which is much simpler and less expensive than prior devices. The sealing assembly of the invention does not require the extra gasket frame called for in the above-cited, commonly owned patent, and therefore is much more reliable and easier to install. The cover member of the instant invention cooperates with the face plate of the skimmer to provide a much improved seal than heretofore possible in the prior art. The skimmer sealing apparatus of the present invention is suitable for use as original equipment when the pool is built or it can be easily retrofitted into existing pool construction.

SUMMARY OF THE INVENTION

Briefly stated, the present invention is directed to a sealing assembly for a swimming pool skimmer comprising a face plate defined by a frame element having a central opening therein communicating with the opening in the skimmer body. The frame element of the face plate has a plurality of spaced-apart holes each adapted to receive a threaded fastener for attaching the face plate to the skimmer whereby the skimmer body is disposed on the outside or dry side of a pool sidewall and the face plate is positioned on the inside or wet side of the sidewall in conventional fashion. The frame element of the face plate carries sealing means around the outer perimeter of the frame element, preferably in the form of a raised flange, outwardly extending perpendicular to the plane of the face plate or in the form of a laterally extending bead around the periphery of the frame element. A cover element constructed of a flexible, plastic material carries an outwardly extending, peripheral lip which is adapted to sealably engage either one of the flange or the bead carried by the face plate to seal off the opening in the skimmer. The flexible, plastic cover element, in one preferred embodiment of the invention, is adapted to sealably bear against the flat frame area of the face plate by virtue of the pressure exerted by the pool water against the outer surface of the cover element to prevent water leakage into the skimmer body. The peripheral lip of the flexible cover element also carries a raised, beveled portion to lockably engage the raised bead on the face plate to insure a mechanical interlock in the sealing assembly.

DETAILED DESCRIPTION OF THE INVENTION

Figure 1:
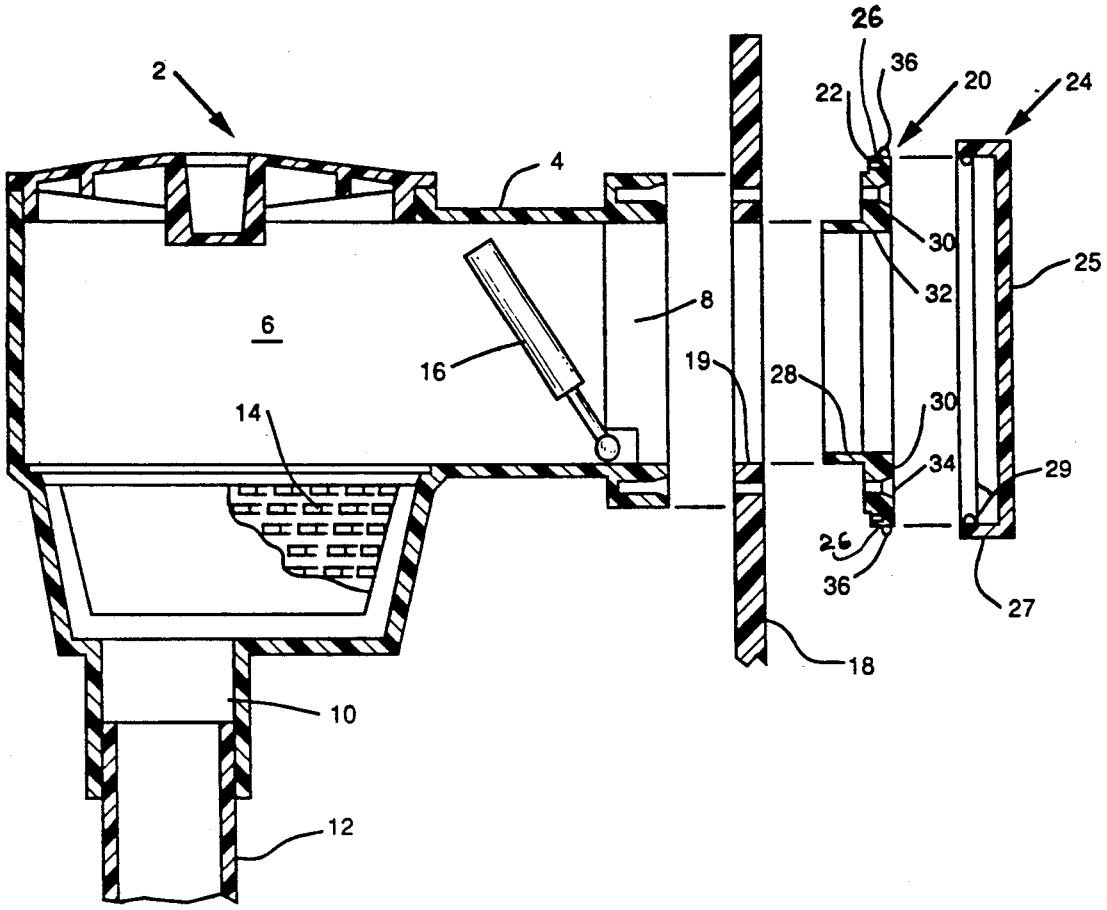
FIG. 1 is a side elevation view of a typical skimmer mounted in a swimming pool sidewall, with the face plate and cover element of the invention in an exploded position adjacent thereto.

Referring now to the drawings, wherein identical reference numerals identify identical elements and primed numerals identify similar elements throughout the various figures, FIG. 1 depicts a typical swimming pool skimmer assembly 2 for drawing off surface water from the pool, spa or hot tub for filtration and possible heating purposes. The assembly 2 includes a body 4, having an open interior 6. The skimmer body 4 has an open inlet 8 on one side of the interior 6 communicating with the swimming pool and an outlet orifice 10 at a lower region of the interior 6. The skimmer outlet orifice 10 is attached to a conduit 12 which carries the pool water from the skimmer to the filtration pump and heater apparatus (not shown) for return to the pool after treatment, in a well-known manner. The skimmer assembly also contains a conventional strainer basket 14 and a buoyant weir 16.

The skimmer assembly 2 is installed at an exterior or outboard side of a sidewall 18 of the swimming pool. The sidewall 18 has an opening 19 formed therein, substantially the same size and shape as the opening at the skimmer inlet 8.

The skimmer sealing assembly, generally designated 20, includes a skimmer face plate 22 and a mating cover element 24. The cover element 24 is drawn in slightly enlarged scale relative to the face plate in order to depict the details of construction in greater detail. The face plate 22 has a frame-like shape having an opening 28 therein for communicating with the inlet opening 8 of the skimmer body. The face plate has a flat border area 30 surrounding opening 28 and laterally extending from sidewall 32 of the opening 28 to a peripheral edge 26 of the face plate, see FIGS. 2, 3 and 4. The face plate 22 also has a plurality of bolt holes 34 formed through the frame-like border area 30 to permit attachment to the inlet end 8 of the skimmer body 4 on the wet or inboard side of the pool sidewall 18.

The skimmer sealing assembly 20 of the invention includes several presently preferred embodiments wherein the cover element 24 sealably engages the face plate 22 utilizing various sealing schemes. The cover element 24 is constructed of a flexible material, preferably a thermoplastic, such as injection molded nylon, polypropylene or the like. The cover element is square or rectangular in shape, sized in plan view to fit snugly around the peripheral edges 26 of the face plate.

In FIG. 1, the face plate 22 carries a laterally extending, raised bead 36 continuously around the peripheral edge 26 thereof. The cover element 24 comprises a planar portion 25, carrying an integral, peripheral lip portion 27 outwardly extending from the planar portion. The lip portion 27 also includes a beveled or raised protrusion 29 depending laterally inwardly, adapted to engage the raised bead 36 when the cover element 24 is placed around the face plate 22. As the cover element 24 is urged toward the face plate 22, the lip portion 27 flexes outwardly to permit the protrusion 29 to move over and beyond the raised bead 36 to cause the cover 24 to sealably engage the face plate 22. In addition to the sealing action provided by the interaction between the lip 27 of the cover element and the raised bead 36 of the face plate, secondary sealing is provided by the bearing contact of the planar portion 25 of the cover element 24 against the flat border surface 30 of the face plate 22. This secondary sealing becomes more effective if the water level in the pool should rise (as during winter months due to accumulated rain/snow). As the pool level rises, the hydrostatic pressure of the water acts on the outer surface of the flexible cover element 24, forcibly urging the planar portion 25 to remain in tight, sealing contact with the flat border surface 30 of the face plate. Thus, pool water is prevented from entering the skimmer interior 6 and the outlet conduit 12 when the cover element 24 is snapped in place as described.

Figure 2:
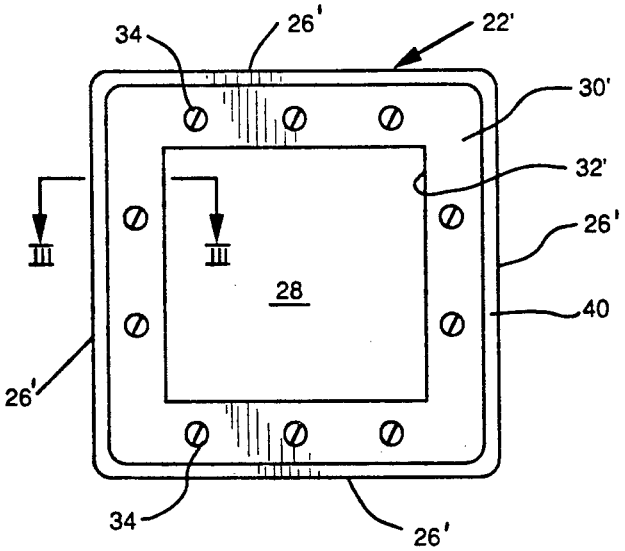
FIG. 2 is a front elevation view of the face plate with a sealing flange therearound.
Figure 3:
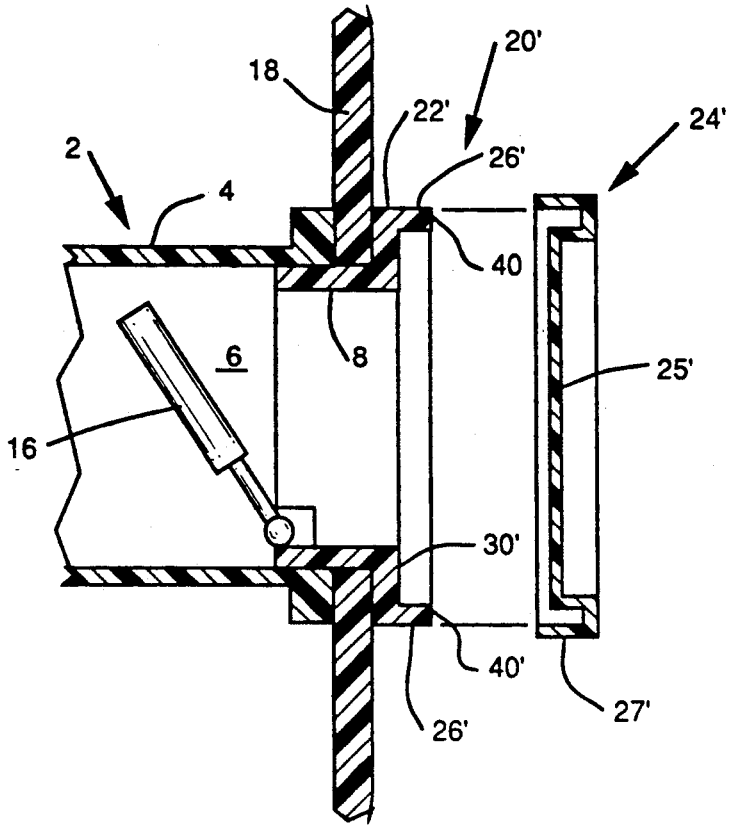
FIG. 3 is a cross-sectional side view of the face plate and a portion of the skimmer body of FIG. 2, with a cover element in sealable engagement therewith.

FIGS. 2 and 3 depict a slightly modified embodiment of the invention, generally designated 20' therein. The skimmer body 4 is mounted along the swimming pool sidewall 18 as previously described. The skimmer face plate 22' has an upstanding or raised flange 40 outwardly extending from the flat border surface 30' around the outer peripheral edge 26' thereof. As seen in FIG. 3, the flange 40 is substantially perpendicular to a plane defined by the flat border surface 30' of the face plate. A modified cover element 24' also constructed of a flexible, thermoplastic material as previously described, includes a planar portion 25' and a generally U-shaped, peripheral lip portion 27'. The U-shaped sides of the lip portion 27' are adapted to snugly engage opposed sides of the raised flange 40 of the face plate completely around the outer peripheral edge 26'. Additionally, the planar portion 25' preferably engages the flat border surface 30' to provide secondary sealing when the cover element is in place.

Figure 4:
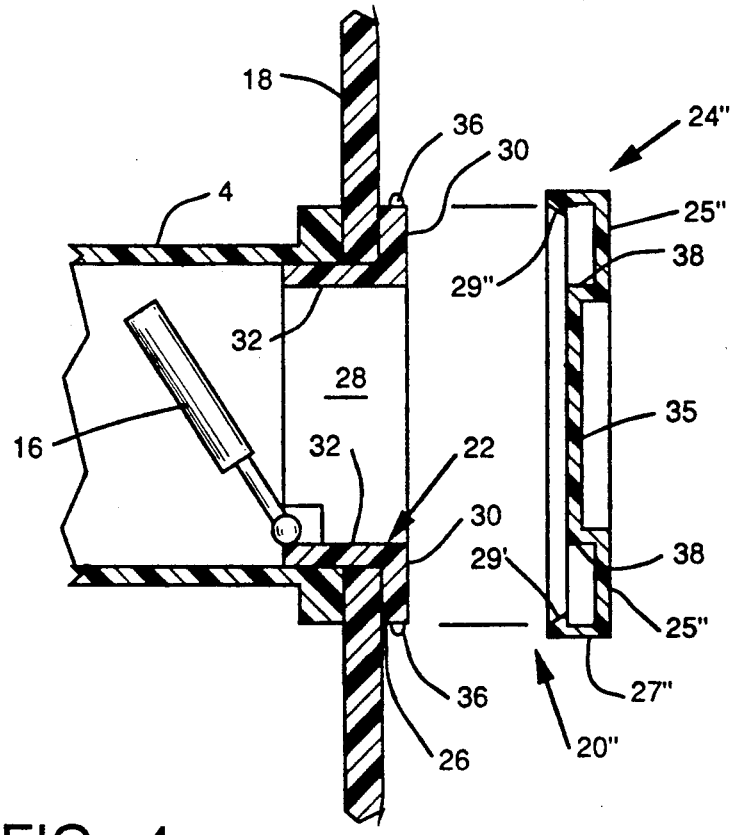
FIG. 4 is a cross-sectional side view similar to FIG. 3 but showing an alternate embodiment of the sealing means carried by the face plate as well as a mating cover element.

A still further presently preferred embodiment of the invention is shown in FIG. 4, identified generally by reference number 20''. In this embodiment, the face plate 22 is substantially the same as that described in FIG. 1. The face plate may carry a raised bead 36 or similar locking means formed around the outer peripheral edge 26. A modified cover element 24'' carries a beveled protrusion 29' along the peripheral lip portion 27'' to first engage and then snap over the raised bead 36. If the face plate 22 does not carry a raised bead 36, then the protrusion 29' is not needed and a flat surfaced lip portion 27 may be used in its place. The cover element 24'' further comprises an outer planar portion 25'' which includes an inwardly depressed central region 35 having 90° sidewalls 38 joining the portion 25'' and region 35 in a step-like configuration. The central region 35 and its 90° sidewalls 38 are configured to slidably and sealably engage sidewalls 32 of the face plate opening 28. The planar portion 25'' is adapted to bear against the flat surface of border 30 to provide additional sealing against water leakage.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A sealing assembly for a swimming pool skimmer of the type having a skimmer body with a water receiving opening therein, said sealing assembly comprising:

a face plate for engaging said skimmer body around said water receiving opening at a sidewall of the swimming pool, said face plate defined by a frame-like element having a central opening therein communicating with the opening in the skimmer body, said face plate having a substantially flat border surface extending around said central opening and including a peripheral edge extending therearound;

sealing means carried by the face plate; and a detachable cover element constructed of a flexible material comprising a planar portion for closing off the central opening in the face plate, said cover element further including an outwardly extending, peripheral lip portion surrounding the planar portion for sealably engaging the peripheral edge around said face plate to prevent pool water from entering the skimmer.

2. The assembly of claim 1 wherein the sealing means carried by the face plate comprises a raised bead extending outwardly around the peripheral edge of the face plate for sealable engagement with the peripheral lip portion of said cover element.

3. The assembly of claim 1 wherein the sealing means carried by the face plate comprises a raised flange outwardly extending from the face plate substantially perpendicular to a plane defined by the flat border of said face plate.

4. The assembly of claim 3 wherein the peripheral lip portion of the cover element is generally U-shaped in cross-section for sealably engaging said raised flange of the skimmer face plate, said cover element further including a planar portion for bearing against the flat border surface of the face plate adjacent the raised flange to provide an additional seal against water leakage.

5. The assembly of claim 4 wherein the cover element is constructed of a thermoplastic material.

6. The assembly of claim 5 wherein the thermoplastic material is polypropylene.

7. The assembly of claim 1 wherein the planar portion of the cover element includes a depressed central region formed therein having sidewalls depending outwardly therefrom for engaging a sidewall surrounding the central opening of the face plate.

8. The assembly of claim 1 wherein the sealing means carried by the face plate includes a raised bead around the peripheral edge thereof and wherein the lip portion of the cover element includes a beveled protrusion constructed and arranged to first engage and then snap over said raised bead when the cover element is applied to said face plate.

* * * * *